United States Patent [19]

Ishigaki et al.

[11] Patent Number: 4,822,727

[45] Date of Patent: Apr. 18, 1989

[54] SILVER HALIDE PHOTOGRAPHIC LIGHT-SENSITIVE MATERIAL

[75] Inventors: Kunio Ishigaki; Yuji Yoshimura; Satoshi Kanetake; Masaaki Torigoe, all of Kanagawa, Japan

[73] Assignee: Fuji Photo Film Co., Ltd., Kanagawa, Japan

[21] Appl. No.: 201,391

[22] Filed: May 25, 1988

Related U.S. Application Data

[63] Continuation of Ser. No. 857,671, Apr. 30, 1986, abandoned.

[30] Foreign Application Priority Data

Apr. 30, 1985 [JP] Japan ..... 60-93325

[51] Int. Cl.[4] ..... G03L 1/76

[52] U.S. Cl. ..... 430/536; 430/523; 430/531; 430/537; 430/627; 430/961

[58] Field of Search ..... 430/523, 536, 537, 627, 430/961, 531

[56] References Cited

U.S. PATENT DOCUMENTS 4,245,036 1/1981 De Winter et al. ..... 430/627

4,381,337 4/1983 Chang ..... 430/60

4,551,412 11/1985 Ogawa et al. ..... 430/533

*Primary Examiner*—Paul R. Michl

*Assistant Examiner*—Lee C. Wright

*Attorney, Agent, or Firm*—Sughrue, Mion, Zinn, Macpeak & Seas

[57] ABSTRACT

A silver halide photographic light-sensitive material having on a support at least one light-sensitive silver halide emulsion layers and at least one light-insensitive upper layers on the emulsion layer, in which at least one of said light-insensitive upper layers contains a polymer latex having a glass transition point of at least 20° C. and the said at least one light-insensitive upper layer and/or at least one other of said at least one light-insensitive upper layer(s) contains a polymer latex having a glass transition point of lower than 20° C. In the silver halide photographic light-sensitive material, at least one of the light-insensitive upper layers can also have a melting time which is longer than that of the light-sensitive silver halide emulsion layer. The silver halide photographic light-sensitive material has high sticking resistance and improved layer strength under low humidity conditions.

14 Claims, No Drawings

SILVER HALIDE PHOTOGRAPHIC LIGHT-SENSITIVE MATERIAL

This is a continuation of application Ser. No. 857,671 filed 4/30/86, now abandoned.

FIELD OF THE INVENTION

This invention relates to a silver halide photographic light-sensitive material and more particularly to a silver halide photographic light-sensitive material having improved antiadhesive property and improved layer strength under low humidity conditions.

BACKGROUND OF THE INVENTION

In silver halide photographic light-sensitive materials, in particular silver halide light-sensitive materials for photo mechanical use (hereinafter, referred to as light-sensitive materials for photo mechanical use), attempts for improving the dimensional stability thereof have been made by adding a polymer latex to a hydrophilic colloid layer thereof as described, for example, in Japanese Patent Publication Nos. 4272/64, 17702/64, 13482/68, 5331/70, U.S Pat. Nos. 2,376,005, 2,763,625, 2,772,166, 2,852,386, 2,853,457, 3,397,988, 3,411,911, 3,411,912, etc.

However, according to the nature of the polymer latexes used, various troubles sometimes occur. That is, when a polymer latex having a glass transition point (hereinafter, is referred to as "Tg") higher than room temperature is used for a hydrophilic cooloid layer of a light-sensitive material, the layer thereof becomes brittle when storing the light-sensitive material under low-humidity conditions and also when a polymer latex having a Tg lower than room temperature is used, the adhesive property or sticking property of the layer is increased and when the light-sensitive materials are stored in the state of being superposed on each other or on other foreign material under high-temperature and high-humidity conditions, adhesion occurs between them. Such a problem is particularly severe when such a polymer latex is incorporated in a light-insensitive upper layer on a light-sensitive silver halide emulsion layer of a light-sensitive material.

Also, for avoiding the occurrence of reticulation in the case of increasing the aptitude for reduction treatment by increasing the hardness of a light-insensitive upper layer of a light-sensitive material such that it is more strongly hardened than the silver halide emulsion layer thereof by the application of a technique of hardening each coated layer separately, a polymer latex, in particular a polymer latex having a Tg not less than room temperature is added to the light-insensitive upper layer of the light-sensitive material as described in British Pat. No. 2,127,570, but in such an embodiment, there is a problem that the coated layer becomes very brittle as described above.

SUMMARY OF THE INVENTION

An object of this invention is, therefore, to provide a photographic light-sensitive material having good dimensional stability, capable of preventing the coated layer(s) from becoming brittle in storage under a low-humidity condition, and causing no adhesion to other light-sensitive material or other material(s) when the light-sensitive material is stored under high-temperature and high-humidity conditions.

Another object of this invention is to provide a photographic light-sensitive material capable of preventing the coated layer(s) from becoming brittle under low-humidity conditions without losing the aptitude for reduction treatment and also preventing the occurrence of adhesion thereof under high-temperature and high-humidity conditions.

As the result of various investigations, the inventors have discovered that the above-described objects can be attained by the present invention as set forth below. That is, the invention provides a silver halide photographic light-sensitive material having on a support at least one light-sensitive silver halide emulsion layer and at least one light-insensitive upper layers on the emulsion layer, in which at least one of the light-insensitive upper layers contains a polymer latex having a glass transition point of at least 20° C. and the said at least one light-insensitive upper layer and/or at least one other of said at least one light-insensitive upper layer(s) contains a polymer latex having a glass transition point of lower than 20° C.

DETAILED DESCRIPTION OF THE INVENTION

The light-insensitive upper layer(s) in this invention are layer(s) substantially composed of a hydrophilic colloid formed over the whole surface of a light-sensitive silver halide emulsion layer. Such a light-insensitive upper layer may be a single layer but, as the case may be, may be composed of two or more such layers.

The polymer latexes which are incorporated in the light-insensitive upper layer(s) of the photographic light-sensitive material of this invention are the hydrates of vinyl polymers of monomers such as acrylic acid esters, methacrylic acid esters, styrenes, etc., as described, for example, in U.S. Pat. Nos. 2,772,166, 3,325,286, 3,411,911, 3,311,912, 3,525,620, *Research Disclosure,* RD No. 19551 (July 1980), etc.

Examples of the preferred polymer latex having the Tg of at least 20° C. for use in this invention are a homopolymer of an alkyl methacrylate such as methyl methacrylate, ethyl methacrylate, etc., a homopolymer of styrene, and a copolymer of an alkyl methacrylate or styrene and acrylic acid, N-methylolacrylamide, glycidol methacrylate, etc.

Also, examples of the preferred polymer latex having the Tg lower than 20° C. for use in this invention are a homopolymer of an alkyl acrylate such as methyl acrylate, ethyl acrylate, butyl acrylate, etc., a copolymer (preferably containing up to 30% by weight of a copolymerizable component such as acrylic acid, etc.) of an alkyl acrylate and the copolymerizable component such as acylic acid, N-methylolacrylamide, etc., a homopolymer of butadiene, a copolymer of butadiene and at least one of styrene, butoxymethylacrylamide and acrylic acid, a ternary copolymer of vinylidene chloride, methyl acrylate, and acrylic acid, etc.

The Tg of a polymer latex can be determined by a differential scanning calorimeteric (DSC) measurement method.

The mean particle size of the polymer latexes for use in this invention is in the range of 0.005 to 1 μm, in particular 0.02 to 0.1 μm. The ratio of the polymer latex having Tg of at least 20° C. to the polymer latex having Tg of lower than 20° C. in this invention is preferably from 80/20 to 30/70, in particular from 70/30 to 40/60 by weight ratio. The addition amount of the polymer latexes (i.e., the sum of both the polymer latexes) is preferably in the range of 5 to 200%, in particular 10 to 100% based on the weight of the hydrophilic colloid of the light-insensitive upper layer(s) to which the polymer latexes are added.

Also, when a large amount of a matting agent, etc., such as a powder of inorganic compound having a mean particle size of 1 to 10 μm and a powder of an organic compound having a Tg of at least 20° C. is added to the above-described light-insensitive upper layer for the purpose of improving writability and improving the adsorptive property of the light-sensitive material on a suction board under vacuum, the layer is liable to be cracked under a low-humidity condition. However, by using the matting agent, etc., together with the polymer latex having a Tg lower than 20° C. in this case, the formation of cracks can be prevented.

When the technique of hardening each coated layer separately as will be described hereinbelow is used, the polymer latexes may be added to a light-insensitive upper layer the melting time of which is longer than that of a silver halide emulsion layer. When two or more light-insensitive upper layers are formed on a silver halide emulsion layer, the polymer latexes may be added to light-insensitive upper layers other than the light-insensitive upper layer the melting time of which is longer than that of the silver halide emulsion layer. For example, it is also preferred that a 2nd light-insensitive upper layer is formed between a silver halide emulsion layer and a light-insensitive upper layer the melting time of which is longer than that of the emulsion layer and the polymer latexes are added to the 2nd light-insensitive layer. Also, when two or more light-insensitive upper layers are employed, the polymer latex having a Tg of at least 20° C. and the polymer latex having Tg of lower than 20° C. may be added to separate light-insensitive upper layers.

Specific examples of the polymer latexes for use in this invention are illustrated below but the invention is not limited thereby in any way.

(1) Examples of the polymer latex having Tg of at least 20° C.:

L-1

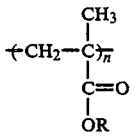

R: $-CH_3$, $-C_2H_5$, $-C_4H_9$

L-2

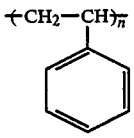

-continued

L-3

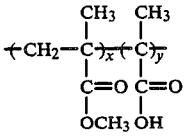

(x/y = 93/7)

L-4

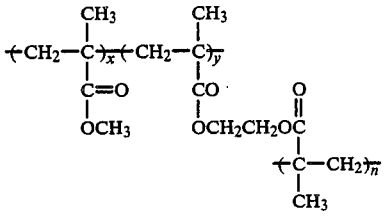

(x/y = 93/7)

L-5

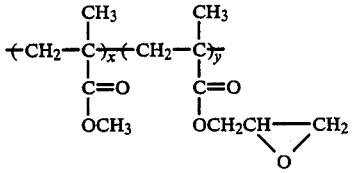

(x/y = 93/7)

L-6

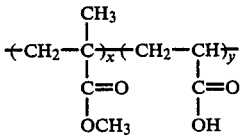

(x/y = 93/7)

L-7

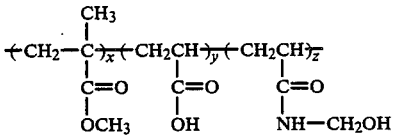

(x/y/z =93/3/4)

L-8

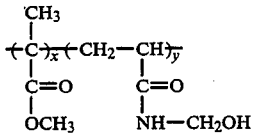

(x/y = 93/7)

L-9

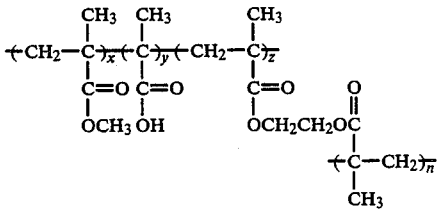

(x/y/z = 93/3/4)

(2) Examples of the polymer latex having Tg of lower than 20° C.:

M-1

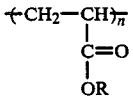

R: $-CH_3$, $-C_2H_5$, $-C_4H_9$

-continued

M-2

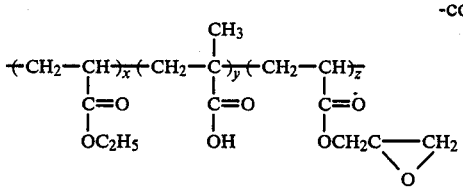

(x/y/z = 93/3/4)

M-3

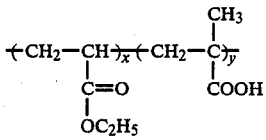

(x/y = 93/7)

M-4

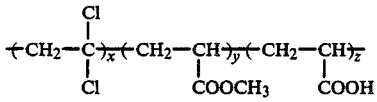

(x/y/z = 85/13/2)

M-5

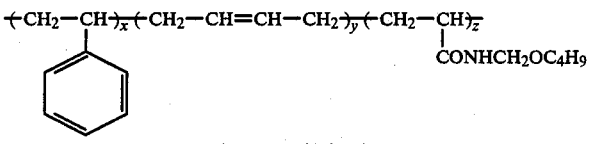

(x/y/z = 64/33/3)

M-6

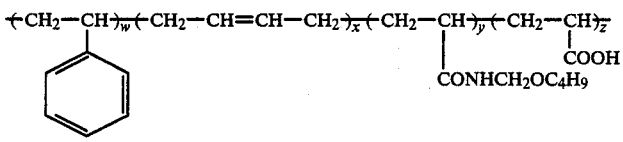

(w/x/y/z = 63/32/3/2)

M-7

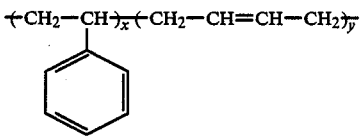

(x/y = 67/33)

M-8

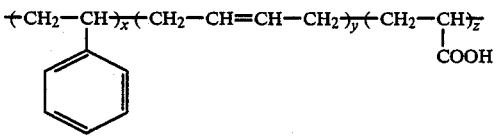

(x/y/z = 59/39/2)

In the above formulae, w, x, y and z are molar percent.

In a more preferred embodiment of this invention, at least one light-insensitive upper layer is constructed so that the melting time of the layer is longer than that of the silver halide emulsion layer disposed under the light-insensitive layer.

By the term "the melting time of a light-insensitive upper layer is longer than that of a silver halide emulsion layer" in this invention is meant that the light-insensitive upper layer is more strongly hardened than the silver halide emulsion layer.

For evaluating the hardened extent or degree of a hardened layer, it is well known in the field of the art to know the degree of swelling of a hardened layer when the layer is swollen by a solution or to know the scratch strength of a hardened layer shown by a load of causing scratches on the layer when the hardened layer is scratched using a styrus loaded by the load. However, for the evaluation of the object of this invention, it is most effective to immerse a hardened layer in a solution kept at a definite temperature and evaluating the hardened extent using the melting time, that is the time until the layer begins to melt. It is most convenient to perform the measurement of the melting time of a hardened layer in an aqueous 0.2N NaOH solution kept at 75° C. although other systems may be employed.

For increasing the melting time of at least one of light-insensitive upper layer(s) over that of the light-sensitive silver halide emulsion layer in this invention, the degree of hardening of the light-insensitive upper layer may be selectively increased over that of the light-sensitive silver halide emulsion layer. In this case, it is preferred that hardening is selectively performed so that the melting time of at least one of the light-insensitive upper layer(s) becomes not less than 50 seconds, particularly not less than 100 seconds longer than that of the silver halide emulsion layer.

For selectively hardening at least one light-insensitive upper layer, there is a method of coating gelatin which is used as the main binder for the light-insensitive upper layer after reacting the gelatin and a diffusible low-molecular weight hardener before coating to an extent of not-reducing the coating character as described, for example, in U.S. Pat. No. 3,362,827. Furthermore, a polymer having a functional group capable of causing a crosslinking reaction with gelatin through a hardener as described in U.S. Pat. No. 4,207,109 can be employed for the purpose.

Moreover, the polymers (polymeric hardeners) having a functional group capable of causing a crosslinking reaction with gelatin described in British Pat. No. 1,322,971, U.S. Pat. Nos. 3,671,256 and 4,323,644, T. H. James, *The Theory of the Photographic Process*, 4th Edition, page 84 (published by MacMillan Co., 1977), Campbell et al, *Polymeric Amine and Ammonium Salts*, pages 321–332 (published by Pargamon Press Co., 1979), etc., are preferably used for attaining the aforesaid purpose of this invention since they are polymeric compounds and hence non-diffusible.

Preferred examples of the polymeric hardeners which are used for the aforesaid purpose in this invention are those shown by the following general formulae (I), (II) and (III) and the polymeric hardeners shown by general formula (I) are particularly preferred.

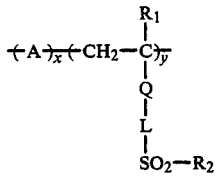

(I)

wherein, A represents an ethylenically unsaturated monomer copolymerizable with the monomer unit shown in the above formula at the right side thereof; $R_1$ represents a hydrogen atom or a lower alkyl group having from 1 to 6 carbon atoms; Q represents $-CO_2-$,

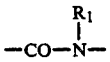

(wherein, $R_1$ is the same as above), or an arylene group having from 6 to 10 carbon atoms; L represents a di-valent group having from 3 to 15 carbon atoms containing at least one of $-CO_2-$ and

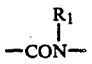

(wherein, $R_1$ is as defined above) or a di-valent group having from 1 to 12 carbon atoms containing at least one linking group selected from the members consisting of —O—,

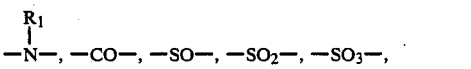

-continued

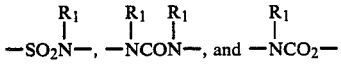

(wherein, $R_1$ is as defined above); and $R_2$ represents a vinyl group ($-CH=CH_2$) or a functional group becoming a precursor of a vinyl group ($-CH_2CH_2X$) (wherein, X represents a group which can be substituted by a nucleophilic group or a group capable of releasing in the form of HX with a base).

Also, in general formula (I), x and y represent molar percent, x being from 0 to 99 and y being from 1 to 100.

Examples of the ethylenically unsaturated monomer shown by A in general formula (I) above are ethylene, propylene, 1-butene, isobutene, styrene, chloromethylstyrene, hydroxymethylstyrene, sodium vinylbenzenesulfonate, sodium vinylbenzylsulfonate, N,N,N-trimethyl-N-vinylbenzyl ammonium chloride, N,N-dimethyl-N-benzyl-N-vinylbenzyl ammonium chloride, α-methylstyrene, vinyltoluene, 4-vinylpyridine, 2-vinylpyridine, benzylvinylpyridinium chloride, N-vinylacetamide, N-vinylpyrrolidone, 1-vinyl-2-methylimidazole, a monoethylenically unsaturated ester of a fatty acid (e.g., vinyl acetate, acryl acetate, etc.), an ethylenically unsaturated monocarboxylic acid or dicarboxylic acid, or a salt thereof (e.g., acrylic acid, methacrylic acid, itaconic acid, maleic acid, sodium acrylate, potassium acrylate, sodium methacrylate, etc.), maleic anhydride, an ester of an ethylenically unsaturated monocarboxylic acid or dicarboxylic acid (e.g., n-butyl acrylate, n-hexyl acrylate, hydroxyethyl acrylate, cyanoethyl acrylate, N,N-diethylaminoethyl acrylate, methyl methacrylate, n-butyl methacrylate, benzyl methacrylate, hydroxyethyl methacrylate, chloroethyl methacrylate, methoxyethyl methacrylate, N,N-diethylaminoethyl methacrylate, N,N,N-trimethyl-N-methacryloyloxyethyl ammonium p-toluenesulfonate, N,N-diethyl-N-methyl-N-methacryloyloxyethylammonium p-toluenesulfonate, dimethyl itaconate, maleic acid monobenzyl ester, etc.), an amide of an ethylenically unsaturated monocarboxylic acid or dicarboxylic acid (e.g., acrylamide, N,N-dimethylacrylamide, N-methylolacrylamide, N-(N,N-dimethylaminopropyl)acrylamide, N,N,N-trimethyl-N-(N-acryloylpropyl)ammonium p-toluenesulfonate, sodium 2-acrylamido-2-methylpropanesulfonate, acryloylmorpholine, methacrylamide, N,N-dimethyl-N'-acryloylpropanediamine propionate betaine, N,N-dimethyl-N'-methacryloylpropanediamine acetate betaine, etc.), etc.

Also, in the case of using the polymer of this invention as a crosslinked latex, other monomers having at least two copolymerizable ethylenically unsaturated groups (e.g., divinylbenzene, methylenebisacrylamide, ethylene glycol diacrylate, trimethylene glycol diacrylate, ethylene glycol dimethacrylate, trimethylene glycol dimethacrylate, neopentyl glycol dimethacrylate, etc.) than the above-described ethylenically unsaturated monomer is used as A.

Examples of the lower alkyl group shown by $R_1$ in general formula (I) are a methyl group, an ethyl group, a butyl group, a n-hexyl group, etc.

Q in general formula (I) includes the following groups.

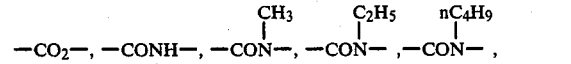

-continued

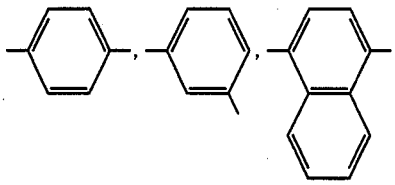

Also, L in general formula (I) includes the following groups.

$-CH_2CO_2CH_2-$, $-CH_2CO_2CH_2CH_2-$, $-CH_2CH_2CO_2CH_2CH_2-$, $-(CH_2)_5CO_2CH_2CH_2-$, $-(CH_2)_{10}CO_2CH_2CH_2-$, $-CH_2NHCOCH_2-$, $-CH_2NHCOCH_2CH_2-$, $(CH_2)_3NHCOCH_2CH_2-$, $-(CH_2)_{10}NHCOCH_2CH_2-$, $-CH_2OCH_2-$, $-CH_2CH_2OCH_2CH_2CH_2-$,

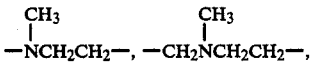

$-COCH_2CH_2-$, $-CH_2COCH_2CH_2-$,

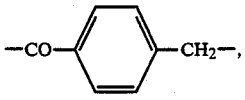

$-SOCH_2CH_2-$, $-CH_2SOCH_2CH_2-$, $-SO_2CH_2CH_2-$, $-SO_2CH_2CH_2SO_2CH_2CH_2-$,

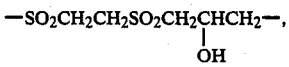

$-SO_3CH_2CH_2CH_2-$, $-SO_3CH_2CO_2CH_2CH_2-$ $-SO_3CH_2CH_2CO_2CH_2CH_2-$, $-SO_2NHCH_2CO_2CH_2CH_2-$, $(CH_2)_5NHCOCH_2CH_2-$ $-SO_2NHCH_2CH_2CO_2CH_2CH_2-$, $-NHCONHCH_2CH_2-$, $-CH_2NHCONHCH_2CH_2-$ $-NHCO_2CH_2CH_2-$, $-CH_2NHCO_2CH_2CH_2-$.

Furthermore, $R_2$ in general formula (I) includes the following groups.

$-CH=CH_2$, $-CH_2CH_2Cl$, $-CH_2CH_2Br$, $-CH_2CH_2O_3SCH_3$,

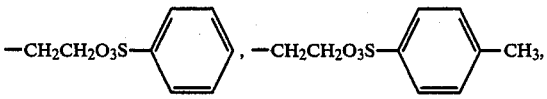

$-CH_2CH_2OH$, $-CH_2CH_2O_2CCH_3$, $-CH_2CH_2O_2CCF_3$, $-CH_2CH_2O_2CCHCl_2$.

Other preferred examples of the polymeric hardener for use in this invention are described, for example, in U.S. Pat. No. 4,161,407 and have the recurring unit represented by general formula (II)

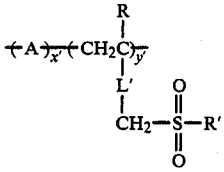

(II)

wherein, A represents an ethylenically unsaturated monomer unit polymerizable with the monomer unit shown in general formula (II) above at the right side thereof or a mixture of the monomers; x' and y' represent molar percent, x' being from 10 to 95% and y' being from 5 to 90%; R represents a hydrogen atom or an alkyl group having from 1 to 6 carbon atoms; R' represents $-CH=CH_2$ or $-CH_2CH_2X$ (wherein, X represents a group capable of being substituted by a nucleophilic group or a group releasing in a form of HX by a base); L' represents a linking group selected from an alkylene group (more preferably a linking group selected from alkylene groups having from 1 to 6 carbon atoms, such as methylene, ethylene, isobutylene, etc.), an arylene group having from 6 to 12 carbon atoms (e.g., a linking group selected from phenylene, tolylene, naphthalene, etc.), —COZ—, and $-COZR_3-$ (wherein, $R_3$ represents an alkylene group having from 1 to 6 carbon atoms or an arylene group having from 6 to 12 carbon atoms and Z represents an oxygen atom or NH).

Examples of A in general formula (II) include the same ones as A in general formula (I). Examples of R in general formula (II) include the same ones as $R_1$ in general formula (I). Also, examples of R' include the same ones as $R_2$ in general formula (I).

Still other preferred polymeric hardeners for use in this invention have the recurring unit represented by the following general formula (III) as described in British Pat. No. 1,534,455.

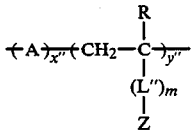

(III)

wherein, A represents an ethylenically unsaturated monomer unit copolymerizable with the monomer unit shown in above general formula (III) at the right side thereof; R represents a hydrogen atom or an alkyl group having from 1 to 6 carbon atoms; L'' represents a di-valent group having from 1 to 20 carbon atoms (more preferably a di-valent group having from 1 to 12 carbon atoms containing at least one linking group selected from the members consisting of —CONH— and —CO—; Z represents an active ester group; x'' and y'' represent molar percent, x'' being from 0 to 95 and y'' being from 5 to 100; and m is 0 or 1.

Examples of A in general formula (III) include the same ones as the examples of A in general formula (I).

Examples of R in general formula (III) include the same ones as the examples of $R_1$ in general formula (I).

L'' in general formula (III) includes the following groups:

$-CONHCH_2-$, $-CONHCH_2CH_2-$, $-CONHCH_2CH_2CH_2-$, $-CONHCH_2CH_2CH_2CH_2CH_2-$, $-COCH_2C-$ $H_2OCOCH_2CH_2$—, —$CONHCH_2CONHCH_2$—, —$CONHCH_2CONHCH_2CONHCH_2$—, —$COCH_2$—, —$CONHCH_2NHCOCH_2CH_2SCH_2CH_2$—, —$CONHCH_2OCOCH_2CH_2$—, etc.

Also, Z in general formula (III) includes the following groups:

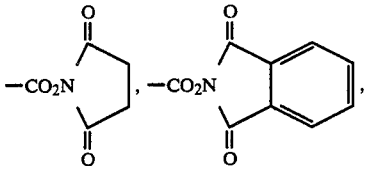

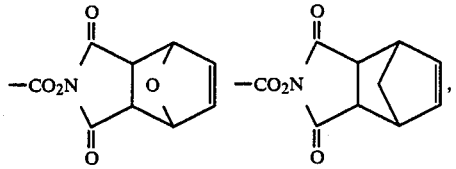

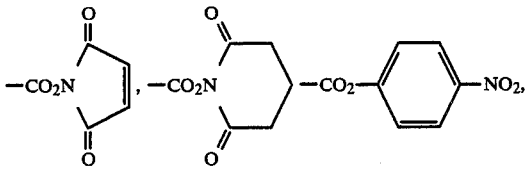

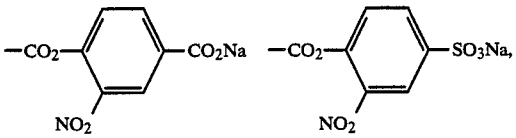

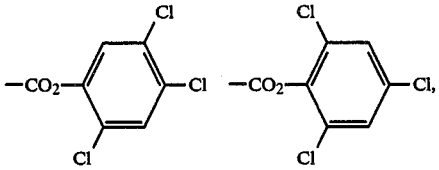

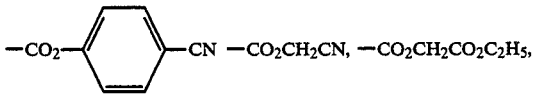

$-CO_2CH_2CONH_2$, $-CO_2CH_2COCH_3$,

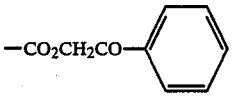

$-CO_2CH_2CO$—, $-CO_2CH_2CO_2CH{=}CH_2$, $-CO_2N{=}CHCH_3$, $-CO_2N{=}C(CH_3)_2$, $-CO_2C(CH_3){=}CHCOCH_3$

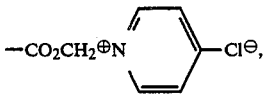

$-CO_2CH_2{}^{\oplus}N$—$Cl^{\ominus}$, $-CO_2CH_2CH_2Br$, $-CO_2CH_2CH_2CN$, $-CO_2CH_2CH_2{}^{\oplus}N(CH_3)_2-CH_3Cl^{\ominus}$ Specific examples of the compounds which can be used as the polymeric hardeners in this invention are illustrated below but the invention is not limited by these compounds in any way.

P-1

$\leftarrow CH_2CH\rightarrow_x$ (CONHC(CH3)2CH2SO3Na)

$\leftarrow CH_2CH\rightarrow_y$ ($COOCH_2CH_2OCOCH_2SO_2CH{=}CH_2$)

x/y = 3/1

P-2

$\leftarrow CH_2CH\rightarrow_x$ (CONHC(CH3)2CH2SO3Na)

$\leftarrow CH_2CH\rightarrow_y$ ($CONHCH_2NHCOCH_2CH_2SO_2CH{=}CH_2$)

x/y = 3/1

P-3

$\leftarrow CH_2CH\rightarrow_x$ (CONHC(CH3)2CH2SO3Na)

$\leftarrow CH_2CH\rightarrow_y$ ($CONHCH_2CH_2CH_2NHCOCH_2CH_2SO_2CH{=}CH_2$)

x/y = 3/1

P-4

$\leftarrow CH_2CH\rightarrow_x$ (CONHC(CH3)2CH2SO3Na)

$\leftarrow CH_2CH\rightarrow_y$

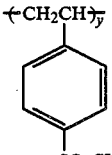

($SO_2CH_2CH_2SO_2CH{=}CH_2$)

x/y = 3/1

P-6

$\leftarrow CH_2CH\rightarrow_x$ (CONHC(CH3)2CH2SO3Na)

$\leftarrow CH_2CH\rightarrow_y$ ($COOCH_2CH_2OCOCH_2SO_2CH_2CH_2Cl$)

x/y = 3/1

P-7

$\leftarrow CH_2CH\rightarrow_x$

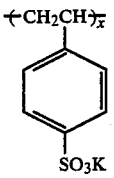

($SO_3K$)

$\leftarrow CH_2CH\rightarrow_y$ ($CONHCOCH_2CH_2SO_2CH_2CH_2Cl$)

x/y = 3/1

P-8

$\leftarrow CH_2CH\rightarrow_x$ (COOM)

$\leftarrow CH_2CH\rightarrow_y$ ($CONHCH_2COCH_2CH_2SO_2CH_2CH_2Cl$)

x/y = 10/1

P-9

$\leftarrow CH_2CH\rightarrow_x$ (COOM)

$\leftarrow CH_2CH\rightarrow_y$ ($CONHCH_2NHCOCH_2CH_2SO_2CH{=}CH_2$)

x/y = 10/1

P-10

$\leftarrow CH_2CH\rightarrow_x$ ($COO(CH_2)_3SO_3Na$)

$\leftarrow CH_2CH\rightarrow_y$ (CONH—)

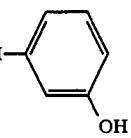

(OH)

-continued x/y = 3/1

P-11

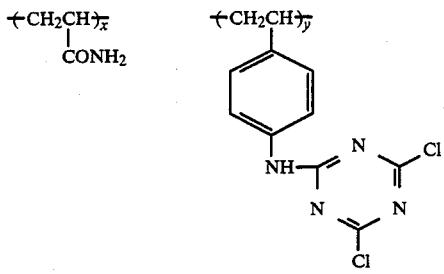

x/y = 20/1

P-12

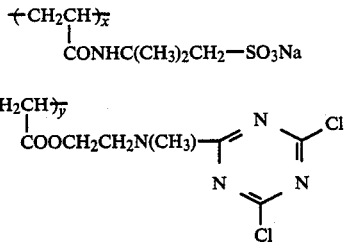

x/y = 5/1

P-13

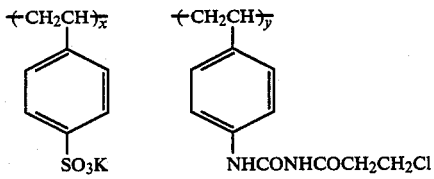

x/y = 10/1

P-14

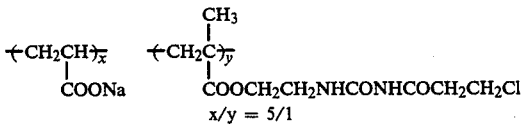

x/y = 5/1

P-15

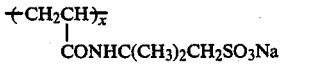

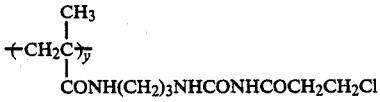

x/y = 10/1

In the above formulae, M is a hydrogen atom, a sodium atom or a potassium atom and x and y are a molar percent of the corresponding units charged. The molar percent is not limited to those specified in the above formulae, x may be from 0 to 99, and y, from 1 to 100.

Preferred examples of the compounds which can be used as the polymeric hardeners in this invention include compounds having a vinyl sulfone group and the precursor thereof as a functional group capable of reacting with gelatin, for example, P-1, P-2, P-3, P-4, P-6, P-7, P-8, P-9, etc. Particularly preferred example of the compound includes P-2.

The amount of the polymeric hardeners which can be used in the present invention is preferably $5\times10^{-5}$ equivalent to 0.1 equivalent, particularly preferably $1\times10^{-4}$ equivalent to $5\times10^{-2}$ equivalent per 100 g of gelatin used in the light-insensitive upper layer expressed in terms of the amount of functional group capable of reacting with gelatin. However, the amount of compounds varies corresponding to a melting time of light-insensitive upper layer.

In the following, specific examples of methods for synthesizing typical ethylenically unsaturated monomers having a vinyl sulfone group or a functional group that is a precursor thereof, which are used for synthesizing polymeric hardeners used in the present invention are described.

SYNTHESIS EXAMPLE 1

Synthesis of 2-[3-(Chloroethylsulfonyl)propionyloxy]ethyl Acrylate

A mixture of 600 ml of tetrahydrofuran, 46.8 g of hydroxyethyl acrylate, and 72 g of 3-(2-chloroethylsulfonyl)propionic acid chloride was placed in a reactor, and while maintaining the temperature at 5° C. or lower by cooling by ice water, a solution containing 31.2 g of pyridine dissolved in 100 ml of tetrahydrofuran was added dropwise thereto over a period of 1.75 hours. The resulting mixture was further stirred for 2 hours at room temperature. At the end of the time, the reaction mixture was poured into 2.5 liters of ice water, and extraction was performed four times with 300 ml of chloroform. The organic layer thus-extracted was dried over sodium sulfate and concentrated to provide 87 g of 2-[3-(chloroethylsulfonyl)propionyloxy]ethyl acrylate which was a liquid at room temperature (decomposed during distillation). Yield was 88%.

SYNTHESIS EXAMPLE 2

Synthesis of N-{[3-Chloroethylsulfonyl)propionyl]aminomethyl}acrylamide

In a 2 liter reactor was introduced 1,400 ml of distilled water, 224 g of sodium sulfite, and 220 g of sodium hydrogencarbonate, which were then stirred to form a uniform solution. Then, while maintaining the temperature at about 5° C. by cooling with ice water, 260 g of chloroethanesulfonyl chloride was added dropwise thereto over a period of 1.5 hours. After the dropwise addition was completed, 160 g of 49% sulfuric acid was added dropwise thereto over a period of about 15 minutes, and the resulting mixture was stirred for 1 hour at 5° C. Crystals precipitated were collected by filtration and washed with 400 ml of distilled water. The filtrate and the washing liquid were combined together and placed in a 3 liter reactor. Into the reactor was introduced dropwise a solution containing 246 g of methylenebisacrylamide dissolved in 480 ml of distilled water and 1,480 ml of ethanol while maintaining the temperature at about 5° C. by cooling with ice over a period of 30 minutes. The reactor was then placed in a refrigerator and was allowed to stand for 5 days to complete the reaction. Crystals precipitated were collected by filtration and, thereafter, they were washed with 800 ml of cooled distilled water and recrystallized from 2,000 ml of a 50% aqueous solution of ethanol to obtain 219 g of the desired monomer.

Yield was 49%, Melting point was 186° to 187° C.

Elemental Analysis (found): H: 5.17, C: 37.90, N: 9.48, C: 12.58.

SYNTHESIS EXAMPLE 3

Synthesis of
[3-(Chloroethylsulfonyl)propionyl]aminomethylstyrene

A mixture of 100 ml of tetrahyrofuran, 20.1 g of vinylbenzylamine, 16.7 g of triethylamine, and 0.1 g of hydroquinone was placed in a reactor, and while cooling with ice water, a solution containing 36.1 g of β-chloroethylsulfonylpropionic acid chloride dissolved in 200 ml of tetrahydrofuran was added dropwise thereto over a period of 30 minutes. The resulting mixture was allowed to stand overnight at room temperature. The reaction mixture was then poured into a solution prepared by diluting 16.5 g of concentrated hydrochloric acid with 1.5 liters of ice water, and the thus formed precipitate was collected by filtration. The precipitate was recrystallized from a solvent mixture of 200 ml of ethanol and 200 ml of water to provide 26.8 g of N-vinylbenzyl-β-chloroethylsulfonyl propionic acid amide.

Yield was 57%, Melting point was 107° to 108° C.

Elemental Analysis (found) H: 5.74, C: 53.47, N: 4.83, Cl: 10.99, S: 10.49.

SYNTHESIS EXAMPLE 4

Synthesis of
1-{[2-(4-Vinylbenzenesulfonyl)ethyl]sulfonyl}-3-chloroethylsulfonyl-2-propanol A mixture of 157 g of 1,3-bischloroethylsulfonyl-2-propanol (prepared by the method described in British Pat. No. 1,534,455), 1 liter of methanol, and 1 liter of distilled water was placed in a reactor, and while maintaining the temperature at 46° C. by heating, a solution prepared by dissolving 52 g of potassium vinylbenzenesulfinate in 100 ml of methanol and 100 ml of distilled water was added dropwise thereto over a period of 1 hour. The resulting mixture was further stirred for 5.5 hours while maintaining at 46° C. The precipitate thus formed was collected by filtration to obtain 55 g of 2-(1-vinylbenzenesulfonyl)ethylsulfonyl-3-chloroethylsulfonyl-2-propanol.

Yield was 49%.

Elemental Analysis (found): H: 4.67, C: 39.89, S: 21.43.

In addition, specific examples of methods of synthesizing polymeric hardeners which can be used in the present invention are described hereinafter.

SYNTHESIS EXAMPLE 5

Synthesis of 2-[3-(Vinylsulfonyl)propionyloxy]ethyl Acrylate/Sodium
Acrylamido-2-methylpropanesulfonate Copolymer
(P-1)

A mixture of 60 ml of N,N-dimethylformamide, 14.5 g of 2-[3-(chloroethylsulfonyl)propionyloxy]ethyl acrylate, and 23.5 g of acrylamido-2-methylpropanesulfonic acid was placed in a reactor. After purging with nitrogen gas, the mixture was heated to 60° C., and 0.40 g of 2,2'-azobis(2,4-dimethylvaleronitrile) was added thereto. The resulting mixture was stirred for 2 hours while heating at that temperature. Subsequently, 0.2 g of 2,2'-azobis(2,4-dimethylvaleronitrile) was added, and the mixture was stirred for 2 hours while heating. At the end of the time, the mixture was cooled down to 5° C., and 12 g of sodium carbonate and 4.9 g of triethylamine were added. The resulting mixture was stirred for 1 hour and additionally for 1 hour at room temperature. The reaction mixture was placed in a tube of cellulose and was subjected to dialysis for 2 days. The product was freeze-dried to obtain 35 g of a white polymer. Yield was 95%. The vinylsulfone content of the polymer thus formed was $0.51\times10^{-3}$ equivalent/g.

SYNTHESIS EXAMPLE 6

Synthesis of
N-{[3-(Vinylsulfonyl)propionyl]aminomethyl}-Acrylamide/Sodium
Acrylamido-2-methylpropanesulfonate Copolymer
(P-2)

A mixture of 5.65 g of the monomer prepared in Synthesis Example 2, 9.16 g of sodium acrylamido-2-methylpropanesulfonate, and 80 ml of a 50% aqueous solution of ethanol was placed in a 200 ml reactor, and was heated to 80° C. while stirring. At this temperature, 0.1 g of 2,2'-azobis(2,4-dimethylvaleronitrile) (sold by Wako Pure Chemical Industries, Ltd. under the trade name of V-65) was added and additionally, after 30 minutes, 0.1 g of the same compound as above was added. The mixture was heated for 1 hour while stirring. Thereafter, the reaction mixture was cooled down to about 10° C. with ice water, and a solution containing 2.5 g of triethylamine dissolved in 80 ml of ethanol was added thereto. Stirring was further continued for 1 hour. At the end of the time, the reaction mixture was poured into 1 liter of acetone while stirring, and the thus formed precipitate was collected by filtration to obtain 12.4 g of Polymer (P-2). Yield was 85%. The intrinsic viscosity, [η], was 0.227, and the vinylsulfone content was $0.95\times10^{-3}$ equivalent/g.

SYNTHESIS EXAMPLE 7

Synthesis of
[3-(Chloroethylsulfonyl)propionyl]aminomethylstyrene/Sodium
Acrylamido-2-methylpropanesulfonate Copolymer
(P-6)

A mixture of 15.8 g of [3-(vinylsulfonyl)propionyl]-aminomethylstyrene, 23.6 g of sodium acrylamido-2-methylpropanesulfonate, and 75 ml of N,N-dimethylformamide was placed in a reactor. After purging with nitrogen gas, the mixture was heated to 80° C., and 0.75 g of 2,2'-azobis(2,4-dimethylvaleronitrile) was added thereto. The resulting mixture was stirred for 3 hours while heating. Then, 25 ml of N,N-dimethylformamide was added, and subsequently 6.1 g of triethylamine was added dropwise at room temperature. The resulting mixture was stirred for 1 hour at room temperature. At the end of the time, the reaction mixture was filtered. The filtrate thus obtained was poured into 800 ml of acetone, and the thus-formed precipitate was collected by filtration and dried to obtain 36.2 g of pale yellow polymer. Yield was 94%. The vinylsulfone content of the polymer thus-formed was $0.80\times10^{-3}$ equivalent/g.

SYNTHESIS EXAMPLE 8

Synthesis of
1-{[2-(4-Vinylbenzenesulfonyl)ethyl]sulfonyl}-3-vinylsulfonyl-2-propanol/Sodium Acrylate Copolymer
(P-19)

A mixture of 300 ml of N,N-dimethylformamide, 40.1 g of 2-(1-vinylbenzenesulfonyl)ethylsulfonyl-3-chloroethylsulfonyl-2-propanol, and 13.0 g of acrylic acid was placed in a reactor. After purging with nitrogen gas, the mixture was heated to 70° C., and 0.53 g of 2,2'-azobis-(2,4-dimethylvaleronitrile) was added thereto. The resulting mixture was heated for 1.5 hours while stirring. Subsequently, 0.53 g of 2,2'-azobis(2,4-dimethylvaleronitrile) was added thereto, and the mixture was further heated for 1 hour while stirring. The reaction mixture was allowed to cool down to room temperature, and 54.8 g of a 28% methanol solution of sodium methylate was added dropwise thereto. Stirring was further continued for 1 hour. The reaction mixture was placed in a tube of cellulose and was subjected to dialysis for 2 days. The product was freeze-dried to obtain 30 g of pale yellow polymer. Yield was 56%. The vinylsulfone content of the polymer thus formed was $1.4\times10^{-3}$ equivalent/g.

For hardening the light-insensitive upper layer(s), the polymeric hardener described above may be used solely or may be used together with a diffusible low-molecular weight hardener. In the latter case, the low molecular weight hardener diffuses into a silver halide emulsion layer to harden the emulsion layer but the light-insensitive upper layer is hardened with both the diffusible low molecular weight hardener and the non-diffusible polymeric hardener, whereby selective high hardening is performed for the light-insensitive upper layer.

As such a diffusible low molecular weight hardener, there are various organic or inorganic hardeners (they may be used solely or as a combination thereof) and specific examples thereof are an aldehyde compound such as mucochloric acid, formaldehyde, trimethylolmelamine, glyoxal, 2,3-dihydroxy-1,4-dioxane, 2,3-dihydroxy-5-methyl-1,4-dioxane, succinaldehyde, glutaraldehyde, etc.; an active vinyl compound such as divinylsulfone, methylenebismaleimide, 1,3,5-triacryloyl-hexahydro-s-triazine, 1,3,5-trivinylsulfonyl-hexahydro-s-triazine, bis(vinylsulfonylmethyl) ether, 1,3-bis(vinylsulfonyl)propanol-2, bis(α-vinylsulfonylacetamido)ethane, 1,2-bis(vinylsulfonyl)ethane, 1,1'-bis(vinylsulfonyl)methane, etc.; an active halogen compound such as 2,4-dichloro-6-hydroxy-s-triazine, etc.; and an ethyleneimine compound such as 2,4,6-triethyleneimino-s-triazine, etc., which are well known in the art as hardeners for gelatin.

For adding the polymeric hardeners in this invention, the hardener is directly added to a layer the degree of hardening of which is controlled by the hardener as a solution thereof in water or an organic solvent. In the case of using the diffusible low molecular weight hardener together with the polymeric hardener in this invention, the diffusible low molecular weight hardener may be added to the light-sensitive upper layer containing the polymeric hardener, or may be added to other light-insensitive upper layer(s) and then diffused in the whole layer. The addition amount of the non-diffusible polymeric hardener is regulated according to the amount of the reactive group of the polymeric hardener.

Also, as another method of controlling the degree of hardening of each coated layer separately, the diffusible property of a low molecular weight hardener used with the polymeric hardener may be controlled by controlling the addition method thereof or a drying condition of the coated layer. For example, a low molecular weight hardener having a vinylsulfone group is incorporated in the coating solution for a surface protective layer only and after simultaneously coating a silver halide emulsion layer and the surface coating layer, the layers are quickly dried, whereby the degree of hardening can be controlled for each layer separately.

Thus, by selectively hardening the layers so that the melting time of at least one light-insensitive upper layer is longer than that of a light-sensitive silver halide emulsion layer, an anisotropy can be rendered to the speed of oxidizing and dissolving a silver image with a reducer. In other words, since at least one light-insensitive upper layer is more strongly hardened than a light-sensitive silver halide emulsion layer for forming silver images, the reducer attacks the silver images more strongly from the direction (the horizontal direction to the plane of the silver halide emulsion layer) of reducing the image area of silver images than the direction (the vertical direction to the plane of the emulsion layer) of reducing the image density of the silver images. Accordingly, in this invention, the contracting width of image areas to the density reduction of silver images, that is the reducing width can be greatly increased.

There is not particular restriction about the coating amount of a hydrophilic colloid binder of the light-insensitive upper layer of this invention but when the amount is the same as or higher than that of the light-sensitive silver halide emulsion, the effect of this invention becomes remarkable.

For example, in the case of a layer structure composed of two light-sensitive silver halide emulsion layers and having another light-insensitive colloid layer between a lignt-insensitive uppermost layer and the light-sensitive silver halide emulsion layer, it is preferred that the sum of the coated amounts of the hydrophilic colloid binders of the uppermost layer and the colloid layer under the uppermost layer is the same as or larger than the sum of the coated amounts of the hydrophilic colloid binders of the two light-sensitive silver halide emulsion layers.

As the hydrophilic colloid binder for the light-insensitive upper layer of this invention, gelatin is advantageously used but other hydrophilic colloids can be also used.

For example, there are proteins such as gelatin derivatives, graft polymers of gelatin and other polymers, albumin, casein, etc.; saccharides including cellulose derivatives such as hydroxyethyl cellulose, carboxymethyl cellulose, cellulose sulfuric acid esters, etc., sodium alginate, starch derivatives, etc.; and various synthetic hydrophilic polymers including a homo- or copolymer such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

As gelatin, lime-processed gelatin as well as acid-processed gelatin and enzyme-processed gelatin as described in *Bull. Soc. Sci. Phot. Japan,* No. 16, 30 (1966) may be used and further the hydrolyzed product or enzyme-decomposition product of gelatin can be used.

The light-insensitive upper layer(s) of this invention may further contain, in addition to the above-described hydrophilic colloid binder (e.g., gelatin) and the polymer latex(es), surface active agents, antistatic agents, matting agents, lubricants, colloidal silica, gelatin plasticizers, etc.

As the matting agent, particles of polymethyl methacrylate or silicon dioxide having particle sizes of about 0.1 to 10 μm, particularly about 1 to 5 μm are preferred.

It is preferred that the light-insensitive upper layer(s) in this invention are coated at a total dry thickness of from about 0.3 to 5 μm, particularly from about 0.5 to 3 μm.

There is no particular restriction about the silver halide used for the light-sensitive silver halide emulsion(s) of the light-sensitive material of this invention and silver chlorobromide, silver chloroiodobromide, silver iodobromide, silver bromide, etc., can be used. In particular, silver chlorobromide or silver chloroiodobromide containing at least 60 mol% (preferably 75 mol% or more silver chloride and containing 0 to 5 mol% of silver iodide is preferred. There are no restrictions about the form, the crystal habit, the grain size distribution, etc., of silver halide grains but silver halide grains having grain size of not more than 0.7 μm are preferred.

The sensitivity of the silver halide emulsion for use in this invention can be increased without coarsening the grain sizes thereof by including a gold compound such as a chloroaurate, gold trichloride, etc.; a salt of a noble metal such as rhodium, iridium, etc., sulfur compound forming silver sulfide by causing reaction with a silver salt; or a reducing substance such as a stannous salt, amines, etc.

Further, it is possible to add a salt of a noble metal such a rhodium, iridium, etc., or an iron compound such as a ferricyanide, etc., at the time of nucleation or physical ripening of silver halide grains.

The silver halide photographic emulsions for use in this invention can be spectrally sensitized or super-sensitized using cyanine dyes such as cyanine, merocyanine, carbocyanine, etc., solely or as a combination thereof or by a combination of the aforesaid dye and a styryl dye, etc. In these dyes, the sensitizing dyes described in Japanese patent application (OPI) Nos. 95836/76, 18311/77, 162247/85 (the term "OPI" used herein refers to a "published unexamined Japanese patent application"), U.S. Pat. No. 3,567,458, etc., can be preferably used.

The silver halide photographic emulsions for use in this invention may further contain various antifoggants such as 4-hydroxy-6-methyl-1,3,3a,7-tetraazaindene, 3-methylbenzothiazole, 1-phenyl-5-mercaptotetrazole, and also many heterocyclic compounds, mercury-containing compounds, mercapto compounds, etc. Furthermore, the antifoggant as described in Japanese patent application (OPI) No. 19429/75, British Pat. No. 1,451,420 and U.S. Pat. Nos. 3,850,639 and 3,898,087 can be also used in this invention.

The light-sensitive silver halide emulsion layers in this invention may contain surface active agents for the purposes of improving the coating property of the coating aids, the photographic characteristics, etc.

Examples of the surface active agents are a natural surface active agent such as saponin, a nonionic surface active agent such as alkylene oxide agents, glycidol agents, etc.; an anionic surface active agent containing an acid group such as a carboxylic acid, a sulfonic acid (e.g., the surface active agents described in U.S. Pat. No. 3,415,649), a phosphoric acid, a sulfuric acid ester, a phosphoric acid ester group, etc.; and an amphoteric surface active agent such as an amino acid, an aminosulfonic acid, a sulfuric acid ester or a phosphoric acid ester of aminoalcohol, etc.

In this invention, a polyalkylene oxide compound can be further used for the silver halide photographic emulsions for the purpose of improvement in toe contrast and dot quality of half-tone image. The polyalkylene oxide compound for use in this invention is a condensation product of a polyalkylene oxide composed of at least 10 units of an alkylene oxide having 2 to 4 carbon atoms, such as ethylene oxide, propylene-1,2-oxide, butylene-1,2-oxide, etc., preferably ethylene oxide and a compound having at least one active hydrogen atom, such as water, an aliphatic alcohol, an aromatic alcohol, a fatty acid, an organic amine, a hexytol derivative, etc., or a block copolymer of two or more kinds of polyalkylene oxides.

Specific examples of the polyalkylene oxide compound for use in this invention are:

polyalkylene glycols,
polyalkylene glycol alkyl ethers,
polyalkylene glycol aryl ethers,
polyalkylene glycol alkylaryl esters,
polyalkylene glycol esters,
polyalkylene glycol fatty acid amides,
polyalkylene glycol amines,
polyalkylene glycol block copolymers,
polyalkylene glycol graft polymers, etc.

Typical examples of the polyalkylene oxide compounds which are preferably used in this invention are as follows.

1. $HO(CH_2CH_2O)_9H$
2. $C_{12}H_{25}O(CH_2CH_2O)_{15}H$
3. $C_8H_{17}CH{=}CHC_8H_{16}O(CH_2CH_2O)_{15}H$
4. 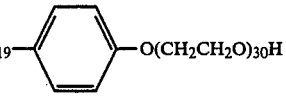
5. $C_{11}H_{23}COO(CH_2CH_2O)_{80}H$
6. $C_{11}H_{23}CONH(CH_2CH_2O)_{15}H$
7. $C_{12}H_{25}N\begin{matrix}(CH_2CH_2O)_{15}H\\(CH_2CH_2O)_{15}H\end{matrix}$
8. $C_{14}H_{29}N(CH_2)(CH_2CH_2O)_{24}H$
9. $H(CH_2CH_2O)_a(\underset{\underset{CH_3}{|}}{C}HCH_2O)_b(CH_2CH_2O)_cH$ $a + b + c = 50$
$b/a + c = 10/9$ In this invention, the silver halide emulsion layer may contain the polymer latex(es) and in this case the emulsion may contain the polymer latex having Tg of at least 20° C. or of lower than 20° C., or both the polymer latexes.

As the hydrophilic binder for the light-sensitive silver halide emulsion layer(s) in this invention, gelatin is advantageously used but other hydrophilic colloids may be used. Specific examples of these colloids are those described above about the binder for the light-insensitive upper layer(s).

The weight ratio of silver halide to hydrophilic colloid binder in the light-sensitive silver halide emulsion layer in this invention is preferably that silver halide/binder is ½ or less.

In this invention, the light-sensitive silver halide emulsion layer may be composed of a single layer or two or more layers.

For example, when the light-sensitive silver halide emulsion layer is composed of two emulsion layers, it is preferred that the ratio of the total amount of silver halide in the two emulsion layers to the total amount of the hydrophilic colloid binder in the two emulsion layers is ½ or less and that the upper light-sensitive emulsion layer contains a larger amount of hydrophilic colloid binder than the lower light-sensitive emulsion layer.

Also, it is preferred that the coating amount of silver halide is from 1.0 to 6.0 g/m$^2$, particularly from 1.3 to 4.0 g/m$^2$ as silver. In addition, the effect of this invention is particularly remarkable when the coating amount of silver is less.

For hardening the light-sensitive silver halide emulsion layer(s), it is preferred to use the low molecular weight hardener as described above but as the case may be, the polymeric hardener or a combination of the polymeric hardener and the low molecular weight hardener can be used.

The present invention can be also applied to a high contrast negative image-forming light-sensitive material using a hydrazine derivative described in U.S. Pat. No. 4,224,401.

As the support for the light-sensitive material of this invention, a polyester film such as a polyethylene terephthalate film, etc., and a cellulose ester film such as a cellulose triacetate film, etc., are preferably used.

In this invention, the light exposure for obtaining images may be performed in an ordinary manner. That is, natural light (sun light), a tungsten lamp, a fluorescent lamp, a mercury lamp, a xenon lamp, an arc lamp, a carbon arc lamp, a xenon flash lamp, a cathode ray tube flying spot, etc., can be used as the light source.

The exposure time may be, as a matter of course, 1/1,000 to 1 sec. for ordinary in camera exposure but may be shorter than 1/1,000 sec., e.g., $1/10^4$ to $1/10^6$ using a xenon flash lamp or a cathode ray tube or may be longer than 1 sec. If necessary, the optical composition of light for light exposure can be controlled using color filter(s). Furthermore, laser light may be used for the light exposure.

There is no particular restriction about the development process for the light-sensitive materials of this invention and ordinary development processes which are used for processing general light-sensitive materials can be used in this invention. The processing temperature is usually from 18° C. to 50° C. but may be lower than 18° C. or higher than 50° C.

The developer which is used for developing the light-sensitive materials of this invention may contain an ordinary developing agent. Examples of the developing agent are dihydroxybenzenes (e.g., hydroquinone), 3-pyrazolidones (e.g., 1-phenyl-3-pyrazolidone, etc.), aminophenols (e.g., N-methyl-p-aminophenol, etc.), 1-phenyl-3-pyrazolines, ascorbic acid, and heterocyclic compounds formed by the condensation of a 1,2,3,4-tetrahydroquinoline ring and an indolene ring described in U.S. Pat. No. 4,067,872. They may be used solely or as a combination thereof.

The developer generally contains, in addition to the developing agent, a preservative, an alkali agent, a pH buffer, an antifoggant, etc., and may, if necessary, contain a dissolving aid, a color toning agent, a development accelerator, a surface active agent, a defoaming agent, a water softener, a hardening agent, a tackifier, etc.

In this invention, a so-called lith-developer may be used for developing the light-sensitive materials of this invention.

For fixing the light-sensitive materials of this invention after development, an ordinary fix solution may be used.

As the fixing agent for the fix solution, thiosulfate, thiocyanates, and also the organic sulfur compounds which are known to have an effect as a fixing agent can be used.

The fixing solution may contain a water-soluble aluminum salt as a hardening agent.

In the case of forming dye images in this invention, conventional methods can be applied.

The development process may be performed by hand working or an automatic developing machine. In the case of automatic development processing, there is no particular restriction about the manner of conveying means (e.g., a roller conveyer or a belt conveyer, etc.), and any conveyance type automatic developing machines which have been used in the field of this art can be used. Furthermore, processing compositions, developing processes, etc., described in U.S. Pat. Nos. 3,025,779, 3,078,024, 3,122,086, 3,149,551, 3,156,173, 3,224,356, 3,573,914, etc., can be used in this invention.

For the silver halide emulsion layers and other layers of the light-sensitive materials of this invention and processes of processing the light-sensitive materials one may refer to the descriptions of *Research Disclosure,* Vol. 176, pages 22 to 28 (December 1978).

Also, there is no particular restriction about the reducer for use in this invention and the reducer described in C.E.K. Mees, *The Theory of the Photographic Process* (Macmillan Co., 1954) can be used as the reducer in this invention.

That is, the reducer for use in this invention contains a permanganate, a persulfate, a ferric salt, a cupric salt, a cerium (IV) salt, a ferricyanide, a dichromate, etc., solely or as a combination thereof. The reducer may further contain, if necessary, an inorganic acid such as sulfuric acid, etc., an alcohol. Furthermore, a reducer containing a reducing component such as a ferricyanide, an ethylenediaminetetraacetatoferrate (III), etc., together with a thiosulfate, a thiocyanate, a thiourea or a derivative thereof, etc., and further, if necessary, an inorganic acid such as sulfuric acid, etc., can be used.

The reducers for use in this invnetion further contain, if necessary, a compound having a mercapto group as described in Japanese patent application (OPI) No. 68419/77.

There are no restrictions about the composition and processing conditions (temperature, time, etc.) of the reducer for use in the reduction treatment in this invention and they can be property determined by a person skilled in the art.

Examples of particular reducers and reducing processes which can be employed, are disclosed in Japanese patent application (OPI) Nos. 140733/76, 68419/77, 14901/78, 119236/79, 119237/79, 2245/80, 2244/80, 17123/80, 79444/80 and 81344/80.

The invention is further explained in detail by referring to the following examples which are not meant to be limiting.

Unless otherwise specified, all percents, ratios, etc. are by weight.

EXAMPLE 1

A silver halide emulsion containing 85 mole% silver chloride, 14.95 mole% silver bromide, and 0.05 mole% silver iodide was gold-sensitized and sulfur-sensitized by ordinary manners. To the emulsion were successively added 5-[3-ethylthiazolinylidene]-3-carboxymethyl-rhodaine (spectral sensitizer), 4-hydroxy-1,3,3a,7-tetraazaindene (stabilizer), polyethylethylene nonylphenyl ether containing 50 ethylene oxide groups, and the polymer latex described in Synthesis Example 3 in U.S. Pat. No. 3,525,620. In this case, potassium polystyrenesulfonate was used as a tackifier. Furthermore, 1,2-bis(vinylsulfonylacetamido)ethane was added thereto as a gelatin hardener in an amount that the coverage thereof became 0.05 g/m$^2$ when the emulsion was coated.

On the other hand, to an aqueous gelatin solution for a light-insensitive upper layer was (or were) added the polymer latex(es) shown in Table 1 described below and further Polymeric Hardener P-2 was added to the gelatin solution as described in Table 1. Also, a matting agent (polymethyl methacrylate having a mean particle size of 3.4 μm) was added thereto in an amount that the coverage thereof became 0.10 g/m$^2$ when the emulsion was coated. Then, the above-described silver halide emulsion layer and the light-insensitive upper layer were coated on a polyethylene terephthalate film support using sodium p-dodecylbenzenesulfonate as a coating aid by a simultaneous multilayer coating method to provide each of Samples 1 to 9. The amount of silver coated in the light-sensitive emulsion layer of each sample was 3.2 g/m$^2$ and the amount of gelatin coated in the light-insensitive upper layer was 1.0 g/m$^2$.

Furthermore, an aqueous gelatin solution containing gelatin, the matting agent, the gelatin hardener, and the coating aid as used above for the coating composition of the light-insensitive upper layer together with a mixture of Dyes (A), (B) and (C) at 1/1/1 was coated on the back side of the support of each sample as a backing layer at a gelatin coverage of 3 g/m$^2$.

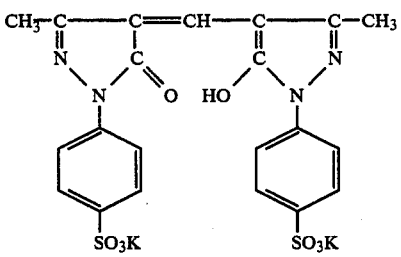

Dye (A)

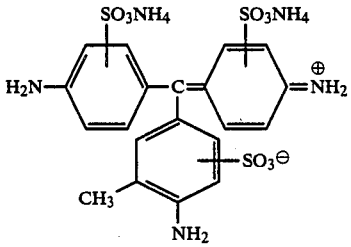

Dye (B)

-continued

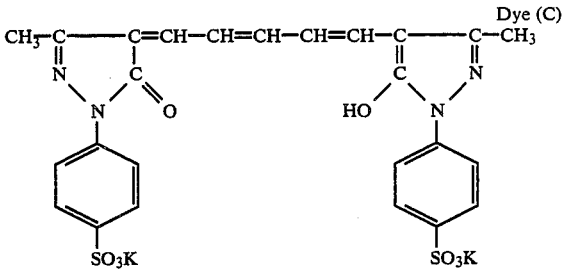

Dye (C)

For each sample thus prepared evaluations of (1) brittleness (cracking), (2) reduction width, (3) reticulation, and (4) antiadhesive property were made.

Evaluation methods were as follows.

(1)

Brittleness (liability of forming cracks):

Each sample was exposed to light, developed using the developer having the composition described below for 20 seconds at 38° C., and then it was fixed, washed with water and dried in a conventional manner. The sample was allowed to stand for 2 hours under conditions of 25° C. and 10% RH (relative humidity) and then the brittleness test was performed on the test according to the method described in ISO 6077-1980 (E).

The results are shown in Table 1 below, wherein a larger value shows that cracks are more liable to form.

Developer

Sodium Carbonate (mono-hydrate), 11 g
Potassium Bromide, 3 g
Hydroquinone, 23 g
1-Phenyl-3-Pyrazolidone, 0.4 g
Sodium Sulfite, 67 g
Potassium Hydroxide, 11 g
Water to make, 1 liter Fixing Solution Ammonium Thiosulfate, 150 g
Sodium Sulfite, 30 g
Potash Alum, 20 g
Acetic Acid, 30 g
Water to make, 1 liter
Sodium hydroxide was added so as to adjust the pH of fixing solution to 4.20

(2)

Reduction Width

A commercially available gray negative contact screen (150 lines/inch) was placed in contact with each sample, and the sample was exposed through a step wedge of 0.1 in step difference to white tungsten light for 10 seconds. Then, the sample was developed as in Test (1) described above.

The dot image strip thus obtained was immersed in a cerium-type reducer having the following composition at 20° C. and washed with water.

Reducer

Ceric Sulfate, 25 g
Concentrated Sulfuric Acid, 30 g
Water to make, 1 liter

The change in dot area of the dot strips thus obtained and the change in density of each dot were measured by means of a microdensitometer, also the dot area when the dot having a dot area of 50% became 2.5 in density of each dot by the reducing processing was measured, and the reduction width was determined by the following equation.

$$\text{Reduction width (\%)} = \text{dot area (\%) before reducing} - \text{dot area (\%) after reducing}$$

(3)

Reticulation

After performing the development process as in Test (1) described above, the extent of the formation of reticulation after processing was observed for each sample using a microscope.

The extent of the formation of reticulation is shown by the following three grades of A, B, and C.

A: No reticulation is observed in the case of observing by a microscope at 100 magnifications.

B: Reticulation is slightly observed in the case of observing by a microscope at 100 magnifications.

C: Reticulation is remarkably observed in the case of observing by a microscope at 100 magnifications.

Each sample was cut into 4 cm×4 cm, after allowing these samples to stand with two pieces as a set for 24 hours at 35° C. and 80% RH (relative humidity), the backing layer of one piece was brought into contact with the light-insensitive upper layer of the other piece in the same set, and they were allowed to stand with a load of 1 kg for 24 hours at 35° C. and 80% RH. Then, the load was removed, both the pieces were separated from each other, and the area of the adhered portion between the backing layer and the light-insensitive upper layer (i.e., the portion colored by the dye transferred from the backing layer onto the light-insensitive upper layer) was measured. The evaluation of the antiadhesive property is as follows.

Rank A: 0 to 25% in the area ratio of adhered portion.

Rank B: 26 to 50% in the area ratio of adhered portion.

Rank C: 51 to 75% in the area ratio of adhered portion.

Rank D: More than 75% in the area ratio of adhered portion.

The results thus obtained are shown in Table 1.

TABLE 1

| Sample No. | P-2 | Compound | Polymer Latex Coated Amount | Polymer Latex Compound | Coated Amount | (1) Brittleness | (2) Reduction Width | (3) Reticulation | (4) Antiadhesive Property |
|---|---|---|---|---|---|---|---|---|---|
| 1 | — | L-1 | 0.45 g/m² | — | — | 45 mm | 8% | A | A |
| 2 | — | " | 0.40 | M-1 | 0.05 g/m² | 6 | 8 | A | A |
| 3 | — | " | 0.27 | " | 0.28 | 0 | 8 | A | A |
| 4 | — | " | 0.09 | " | 0.36 | 0 | 8 | A | B |
| 5 | 0.09 g/m² | " | 0.45 | — | — | 50 | 15 | A | A |
| 6 | " | " | 0.40 | M-1 | 0.05 | 8 | 15 | A | A |
| 7 | " | " | 0.27 | " | 0.28 | 0 | 15 | A | A |
| 8 | " | " | 0.09 | " | 0.36 | 0 | 14 | A | B |
| 9 | " | L-7 | 0.45 | — | — | 47 | 16 | A | A |
| 10 | " | " | 0.40 | M-1 | 0.05 | 6 | 15 | A | A |
| 11 | " | " | 0.27 | " | 0.28 | 0 | 16 | A | A |
| 12 | " | " | 0.09 | " | 0.36 | 0 | 16 | A | B |
| 13 | " | — | — | " | 0.45 | 0 | 15 | A | D |

L-1: 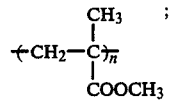

(Tg = 105° C.)

L-7: 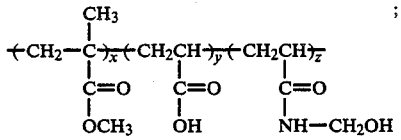

(x/y/z = 93/3/4)

(Tg = 105° C.)

M-1: 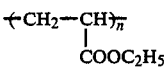

(Tg = =20° C.)

In addition, the samples shown in Table 1 above all showed good dimensional stability. As is clear from the results shown in Table 1, Samples 2 to 4 of this invention showed good antiadhesive property and no cracks under low humidity condition. Also, Samples 6 to 8 and Samples 10 to 12 of this invention showed excellent effects that the aptitude for reduction treatment was good, the antiadhesive property was good, no reticulation occurred, and no crack occurred under low humidity conditions.

EXAMPLE 2

A silver halide emulsion containing 80 mole% silver chloride, 19.95 mole% silver bromide, and 0.05 mole% silver iodide was gold-sensitized and sulfur-sensitized by ordinary manners. To the emulsion were added 3-carboxymethyl-5-[2-(3-ethyl-thiazolinylidene)ethylidene]rhodanine (spectral sensitizer), the stabilizer, the polymer latex, the tackifier and the gelatin hardener as used in Example 1.

On the other hand, the polymer latex(es) shown in Table 2 described below were added to an aqueous gelatin solution for a light-insensitive upper layer and further Polymer Hardener P-2 was added thereto as shown in Table 2 below. Then, after adding thereto a matting agent (silicon dioxide having a mean particle size of 3.3 μm) as shown in Table 2 together with other additives as in Example 1, each emulsion was coated on a polyethylene terephthalate film support by the same coating method as in Example 1 to provide each of Samples 10 to 14. The amount of silver coated in the light-sensitive emulsion layer of each samples was 3.5 g/m² and the amount of gelatin coated in the light-insensitive upper layers was 1.2 g/m².

Furthermore, a backing layer having the same composition as that in Example 1 was formed at the back side of the support of each sample. Each of the samples thus prepared was evaluated as in Example 1 and the results thus obtained are shown in Table 2 below.

As is clear from the results of Table 2, Sample 14 of this invention showed excellent effects that the reduction width characteristics were not reduced, the antiadhesive property was good, no reticulation occurred, and no crack occurred under low humidity conditions.

TABLE 2

| Sample No. | P-2 | Polymer Latex L-1 | Polymer Latex M-1 | Matting Agent | Brittleness | Reduction Width (%) | Reticulation | Antiadhesive Property |
|---|---|---|---|---|---|---|---|---|
| 10 | 0.10 g/m$^2$ | — | — | 0.17 g/m$^2$ | 8 mm | 13 | A | A |
| 11 | — | — | 0.30 g/m$^2$ | " | 0 | 8 | A | D |
| 12 | 0.10 g/m$^2$ | 0.30 g/m$^2$ | — | — | 25 mm | 14 | C | A |
| 13 | " | " | — | 0.17 g/m$^2$ | 35 mm | 14 | A | A |
| 14 | " | 0.18 g/m$^2$ | 0.12 g/m$^2$ | " | 0 | 14 | A | A |

L-1:

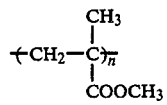

Tg = 105° C.

M-1:

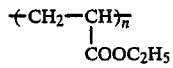

Tg = −20° C.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material having on a support at least one light-sensitive silver halide emulsion layer and at least one light-sensitive upper layer on the emulsion layer, in which at least one of said light-insensitive upper layer contains a polymer latex having a glass transition point of at least 20° C. and at least one of said light-insensitive upper layer contains a polymer latex having a glass transition point of lower than 20° C.

2. The silver halide photographic light-sensitive material as claimed in claim 1, wherein at least one of the light-insensitive upper layer has a melting time which is longer than that of the light-sensitive silver halide emulsion layer.

3. The silver halide photographic light-sensitive material as claimed in claim 1, wherein the mean particle size of the polymer latexes is in the range of from 0.005 to 1 μm.

4. The silver halide photographic light-sensitive material as claimed in claim 3, wherein the mean particle size of the polymer latexes is in the range of from 0.02 to 0.1 μm.

5. The silver halide photographic light-sensitive material as claimed in claim 1, wherein the ratio of the polymer latex having Tg of at least 20° C. to the polymer latex having Tg of lower than 20° C. is from 80/20 to 30/70 by weight ratio.

6. The silver halide photographic light-sensitive material as claimed in claim 5, wherein the ratio of the polymer latex having Tg of at least 20° C. to the polymer latex having Tg of lower than 20° C. is from 70/30 to 40/60 by weight ratio.

7. The silver halide photographic light-sensitive material as claimed in claim 1, wherein the addition amount of the polymer latexes is in the range of 5 to 200% based on the weight of the hydrophilic colloid of the layer(s) to which the polymer latexes are added.

8. The silver halide photographic light-sensitive material as claimed in claim 7, wherein the addition amount of the polymer latexes is in the range of 10 to 100% based on the weight of the hydrophilic colloid of the layer(s) to which the polymer latexes are added.

9. The silver halide photographic light-sensitive material as claimed in claim 2, wherein the melting time of the light-insensitive upper layer measured in a 0.2N NaOH solution at 75° C. is at least 50 seconds longer than the melting time of the light-sensitive silver halide emulsion layer.

10. The silver halide photographic light-sensitive material as claimed in claim 9, wherein the melting time of the light-insensitive upper layer measured in a 0.2N NaOH solution at 75° C. is at least 100 seconds longer than the melting time of the light-sensitive silver halide emulsion layer.

11. The silver halide photographic light-sensitive material as claimed in claim 1, wherein the light-insensitive upper layer is hardened with a polymeric hardener.

12. The silver halide photographic light-sensitive material as claimed in claim 1, wherein the polymer latex having a glass transition point of at least 20° C. and the polymer latex having a glass transition point of lower than 20° C. are contained in the same light-insensitive upper layer.

13. The silver halide photographic light-sensitive material as claimed in claim 1, wherein the polymer latex having a glass transition point of at least 20° C. and the polymer latex having a glass transition point of lower than 20° C. are contained in different light-insensitive upper layers.

14. The silver halide photographic light-sensitive material as claimed in claim 12, wherein said same light-insensitive upper layer is a protective layer.

* * * * *